US010851707B2

(12) United States Patent
Derra et al.

(10) Patent No.: US 10,851,707 B2
(45) Date of Patent: Dec. 1, 2020

(54) INVERTER GENERATOR

(71) Applicant: Briggs & Stratton Corporation, Wauwatosa, WI (US)

(72) Inventors: Mike Derra, Pewaukee, WI (US); Ryan S. Jaskowiak, Mukwonago, WI (US); Ken Stair, North Prairie, WI (US); Ed Strommen, Hartland, WI (US); Mark Willer, Brookfield, WI (US); Brian Matthew Holzman, Waukesha, WI (US); Patrick J. Crowley, Naperville, IL (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 0 days.

(21) Appl. No.: 16/080,126

(22) PCT Filed: Mar. 2, 2017

(86) PCT No.: PCT/US2017/020501
§ 371 (c)(1),
(2) Date: Aug. 27, 2018

(87) PCT Pub. No.: WO2017/151956
PCT Pub. Date: Sep. 8, 2017

(65) Prior Publication Data

US 2019/0055884 A1 Feb. 21, 2019

Related U.S. Application Data

(60) Provisional application No. 62/302,246, filed on Mar. 3, 2016.

(51) Int. Cl.
*F02B 63/04* (2006.01)
*F04B 17/05* (2006.01)
(Continued)

(52) U.S. Cl.
CPC ..... *F02B 63/047* (2013.01); *F01N 1/026* (2013.01); *F02B 63/044* (2013.01); *F02F 7/00* (2013.01);
(Continued)

(58) Field of Classification Search
CPC .. F02B 63/047; F02B 2063/045; F04B 17/05; F01N 1/026
See application file for complete search history.

(56) References Cited

U.S. PATENT DOCUMENTS 3,616,867 A 11/1971 Celli
4,054,115 A 10/1977 V. Habsburg-Lothringen
(Continued)

FOREIGN PATENT DOCUMENTS

CN 202325832 U 7/2012
CN 204458021 U 7/2015

OTHER PUBLICATIONS

International Search Report and Written Opinion, PCT/US2017/020501, Briggs & Stratton Corporation, 7 pages (dated May 11, 2017).

*Primary Examiner* — Shafiq Mian
(74) *Attorney, Agent, or Firm* — Foley & Lardner LLP

(57) ABSTRACT

A generator includes an elongated tubular frame, an internal combustion engine attached to the elongated tubular frame, the engine including an engine block including a cylinder and a crankshaft configured to rotate about a crankshaft axis. The generator further includes a fuel tank attached to the elongated tubular frame. The elongated tubular frame is configured to simultaneously support the internal combustion engine and the fuel tank.

19 Claims, 20 Drawing Sheets

(51) Int. Cl.
*F04B 39/06* (2006.01)
*F02F 7/00* (2006.01)
*F01N 1/02* (2006.01)

(52) U.S. Cl.
CPC ..... *F04B 17/05* (2013.01); *F04B 39/06* (2013.01); *F02B 2063/045* (2013.01)

(56) References Cited

U.S. PATENT DOCUMENTS 5,245,960 A 9/1993 Macier et al.
6,362,533 B1 * 3/2002 Morohoshi ..... F02B 63/04 123/41.56
6,464,028 B1 * 10/2002 Imani ..... B60K 6/26 180/65.25
2001/0029733 A1 * 10/2001 Suzuki ..... F02B 63/04 60/796
2001/0035148 A1 * 11/2001 Ito ..... F02F 1/06 123/196 R
2002/0126853 A1 * 9/2002 Stuart ..... G10K 11/172 381/71.5
2003/0184094 A1 * 10/2003 Sodemann ..... F02B 63/04 290/1 A
2009/0302788 A1 * 12/2009 Mitsuda ..... H02P 3/18 318/376
2012/0042477 A1 * 2/2012 Junk ..... B25F 5/02 16/429
2012/0124955 A1 * 5/2012 Klika ..... A01D 42/00 56/17.3
2013/0305851 A1 * 11/2013 Rees ..... F16D 11/08 74/15.8
2014/0151148 A1 6/2014 Pradhan
2015/0059662 A1 * 3/2015 Lan ..... F02B 63/048 123/2
2017/0314451 A1 * 11/2017 Jochman ..... F02B 63/044

* cited by examiner

INVERTER GENERATOR

CROSS-REFERENCE TO RELATED APPLICATIONS

This application is a National Stage Application of PCT/US2017/020501, filed Mar. 2, 2017, which claims the benefit of U.S. Provisional Application No. 62/303,246, filed Mar. 3, 2016, both of which are incorporated herein by reference in their entireties.

BACKGROUND

The present invention relates generally to the field of inverter generators.

SUMMARY

One embodiment of the invention relates to a generator. The generator includes an elongated tubular frame, an internal combustion engine attached to the elongated tubular frame, the engine including an engine block including a cylinder and a crankshaft configured to rotate about a crankshaft axis, and a fuel tank attached to the elongated tubular frame, where the elongated tubular frame is configured to simultaneously support the internal combustion engine and the fuel tank.

Another embodiment of the invention relates to a generator. The generator includes an internal combustion engine including an engine block including a cylinder, and a crankshaft configured to rotate about a crankshaft axis, and a muffler including a muffler pipe extending along a muffler pipe axis and terminating at a muffler exhaust, where the muffler pipe axis is substantially perpendicular to the crankshaft axis.

Alternative exemplary embodiments relate to other features and combinations of features as may be generally recited in the claims.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to the figures generally, an inverter generator is shown according to an exemplary embodiment. Inverter generators output alternating current (AC) and that current is then converted to direct current (DC), and then inverted back to clean AC power that maintains a single phase, pure sine wave, at the required voltage and frequency. On an inverter generator, the engine is connected to an alternator, which produces AC electricity, a rectifier is used to convert the AC power to DC and capacitors are used to smooth the power out. The DC power is then inverted back into clean AC power of the desired frequency and voltage (e.g., 120 VAC@60 Hz). The result from an inverter generator is much cleaner power, or purer sine waves, than is possible with a typical generator. This may become important when using devices with microprocessors, which are typically very sensitive to the quality of electricity used. Using a relatively poor quality of electricity may cause malfunction or damage the devices. Thus, any application using sensitive electronics will likely benefit from the cleaner power provided by an inverter generator.

Additionally, an inverter generator may be relatively more fuel efficient and have the capability of adjusting engine speed according to load, which conventional generators may not be able to do. The fuel efficiency of an inverter generator additionally helps to reduce fuel consumption and exhaust emissions over a conventional generator. Inverter generators may also reduce noise. Quieter engines, special mufflers, and sound-dampening technology may be used on inverter generators to reduce noise relative to conventional generators. In addition, conventional units generally run at a constant speed to produce electricity with the desired characteristics, and in turn, produce constant noise. Inverter generators, on the other hand, may adjust the electrical characteristics of the power produced using microprocessors and special electronics. This means that the engine can throttle back when the load is light, saving fuel and substantially reducing noise.

Figure 1:
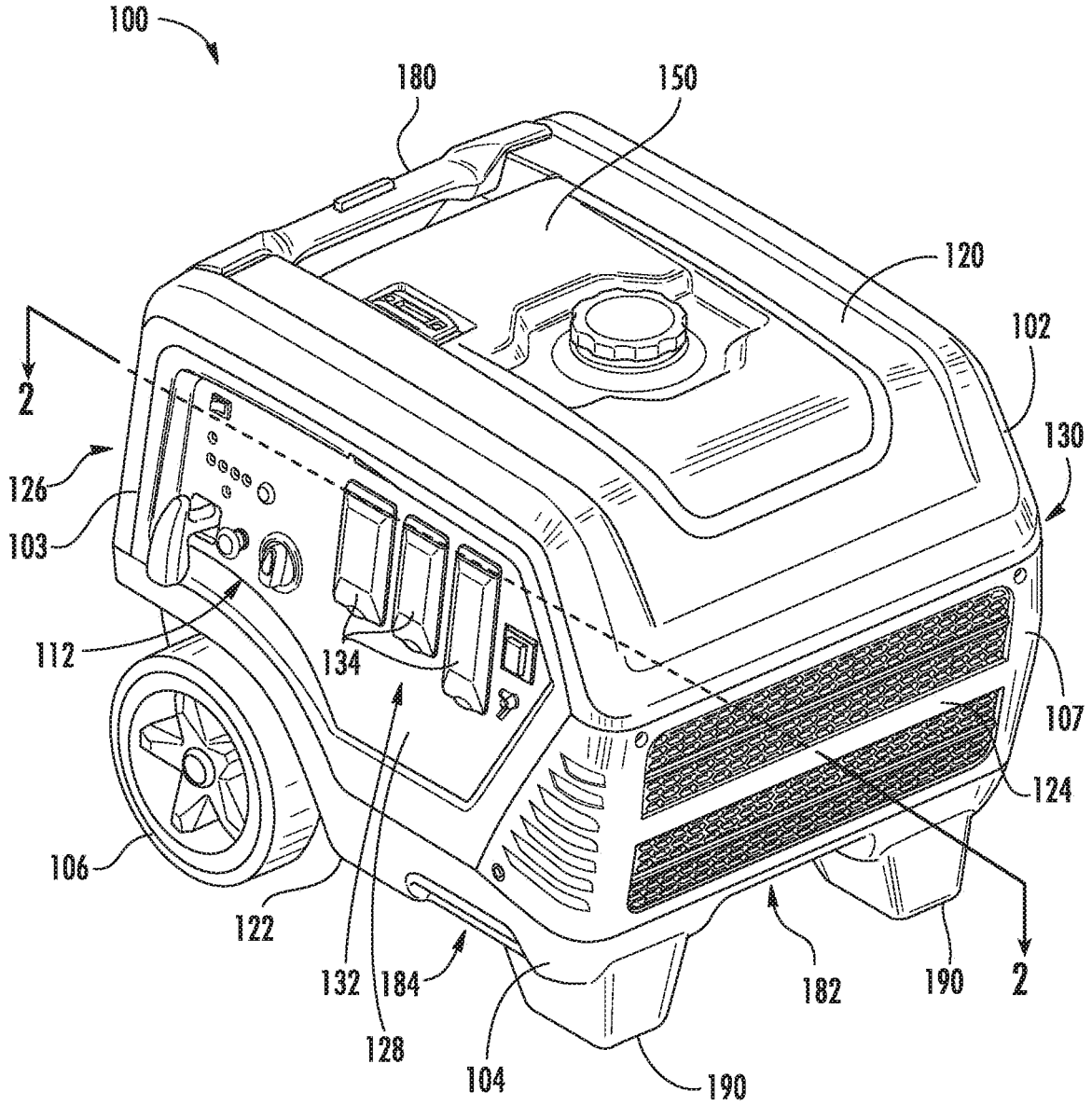
FIG. 1 is a right perspective view from above of an inverter generator, according to an exemplary embodiment.
Figure 2:
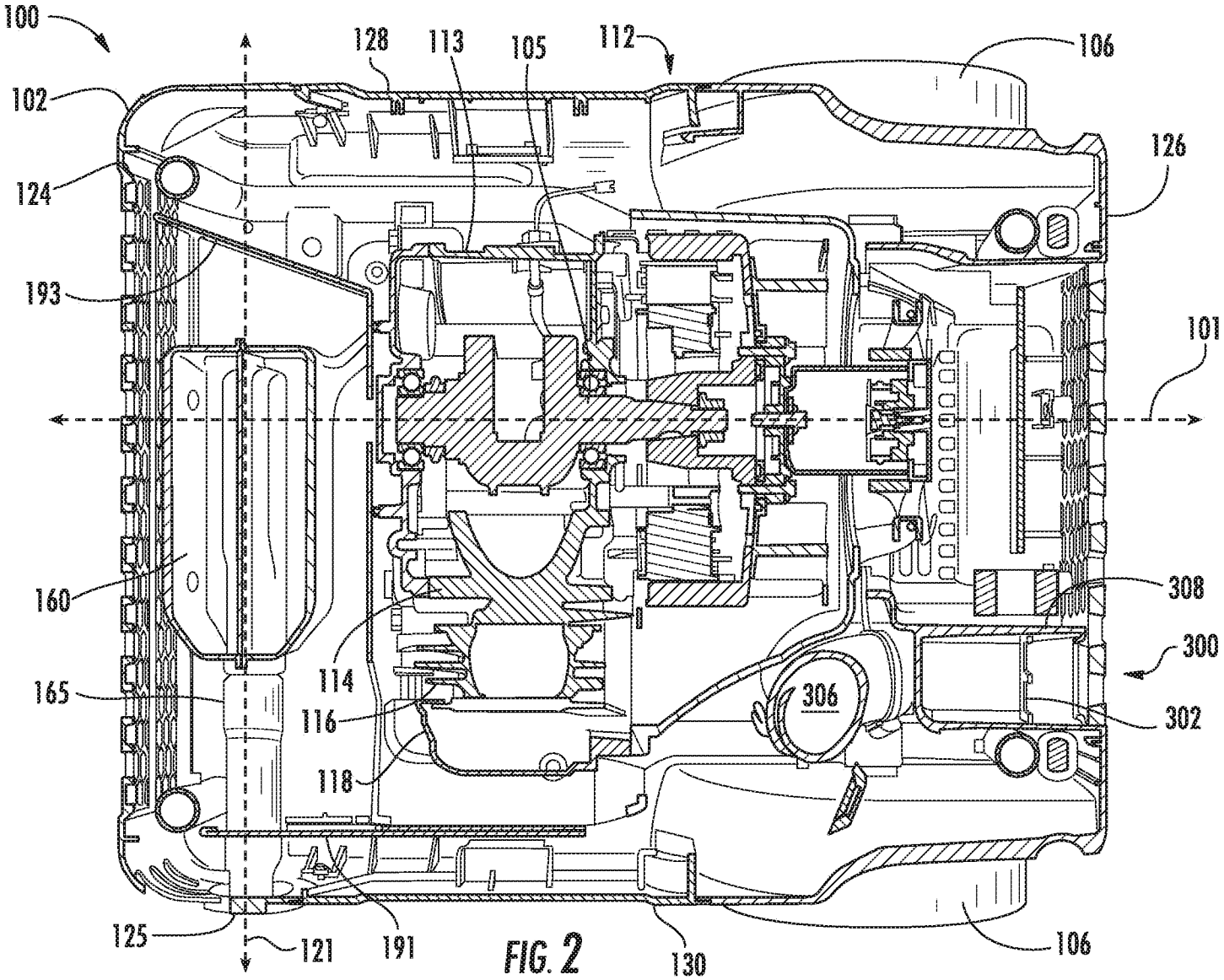
FIG. 2 is a section view of the inverter generator of FIG. 1 along section line 2-2, according to an exemplary embodiment.

Referring to FIGS. 1-2, an inverter generator 100 is shown according to an exemplary embodiment. The inverter generator 100 includes an engine 110, controller 123, alternator 140, fuel tank 150, and muffler 160. The controller 123 includes an inverter 129, which inverts the DC power to clean AC power of a desired frequency and voltage (e.g., 120 VAC@60 Hz). The inverter generator 100 uses the engine 110, receiving fuel from the fuel tank 150 and air from the air intake 170, in combination with an alternator 140 and controller 123 to produce clean power. The engine 110 includes an engine block 114 having at least one cylinder 116, a cylinder head 118, piston, and crankshaft 105. Each piston reciprocates in a cylinder 116 along a cylinder axis to drive the crankshaft 105. The crankshaft 105 rotates about a crankshaft axis 101. The crankshaft 105 is positioned in part within a sump or crankcase cover 113. The muffler 160 acts as part of an exhaust system to reduce the exhaust noise from the inverter generator 100.

The inverter generator 100 includes a housing 102 to house the components of the inverter generator 100. In some embodiments, the housing 102 may be made from plastic. In other embodiments, the housing 102 may be made from any other suitable material. The inverter generator includes a top 120, bottom 122, front 124, rear 126, left 128, and right 130 sides. A control panel 112 is positioned on the housing 102. As illustrated in FIG. 1, the control panel 112 is positioned on the left side 128 of the inverter generator 100. The control panel 112 serves as a user interface during operation of the inverter generator 100. The control panel 112 includes one or more outlets 132 positioned on the control panel 112, with one or more outlet covers 134. In some embodiments, the outlet covers 134 are magnetically sealed. In other embodiments, the outlet covers 134 include flip-type covers, where the cover can be opened by flipping the cover either up, down, or to the side to facilitate access to an outlet 132. In still other embodiments, the outlet covers 134 are bubble-type covers or flat-type covers that act as a shield for the outlets 132 and the control panel 112 of the inverter generator 100. Additionally, the outlet covers 134 provide weather-proofing to the outlets 132.

The inverter generator 100 may also include one or more indication lights positioned on the control panel 112. The one or more indication lights may be of various colors and/or may be capable of changing color and may be used to indicate the status of the inverter generator. As an example, a green light may indicate that the inverter generator is in an operating mode, a yellow light may indicate that the inverter generator is on standby, and a blue light may indicate that the inverter generator is off. Other colors and/or combinations may be used to indicate one or more modes of the inverter generator.

The inverter generator 100 also includes a bottom tray 104. In some embodiments, the housing 102 includes the bottom tray 104. In other embodiments, the housing 102 and the bottom tray 104 are formed as separate pieces. The inverter generator 100 includes one or more wheels 106 that facilitate the transport of the generator 100. The wheels 106 are positioned on or near where the rear side 126 meets the bottom side 122 of the inverter generator.

The housing 102 includes one or more housing pieces (e.g., a first housing piece 103, a second housing piece 107). In some embodiments, the housing pieces are formed such that the first housing piece 103 includes a protrusion configured to mate with a channel in the second housing piece 107, such that a sealing device (e.g., gasket, O-ring, compression seal) is placed between the pieces 103, 107 forming a seal between the two pieces. The sealing device may improve performance of the inverter generator under wet conditions, such as rain or snow. The sealing device may additionally reduce noise due to less rattling of the housing pieces. Additionally, the sealing device may improve compliance of the inverter generator with certain industry standard testing (e.g., European conformity testing).

Figure 3:
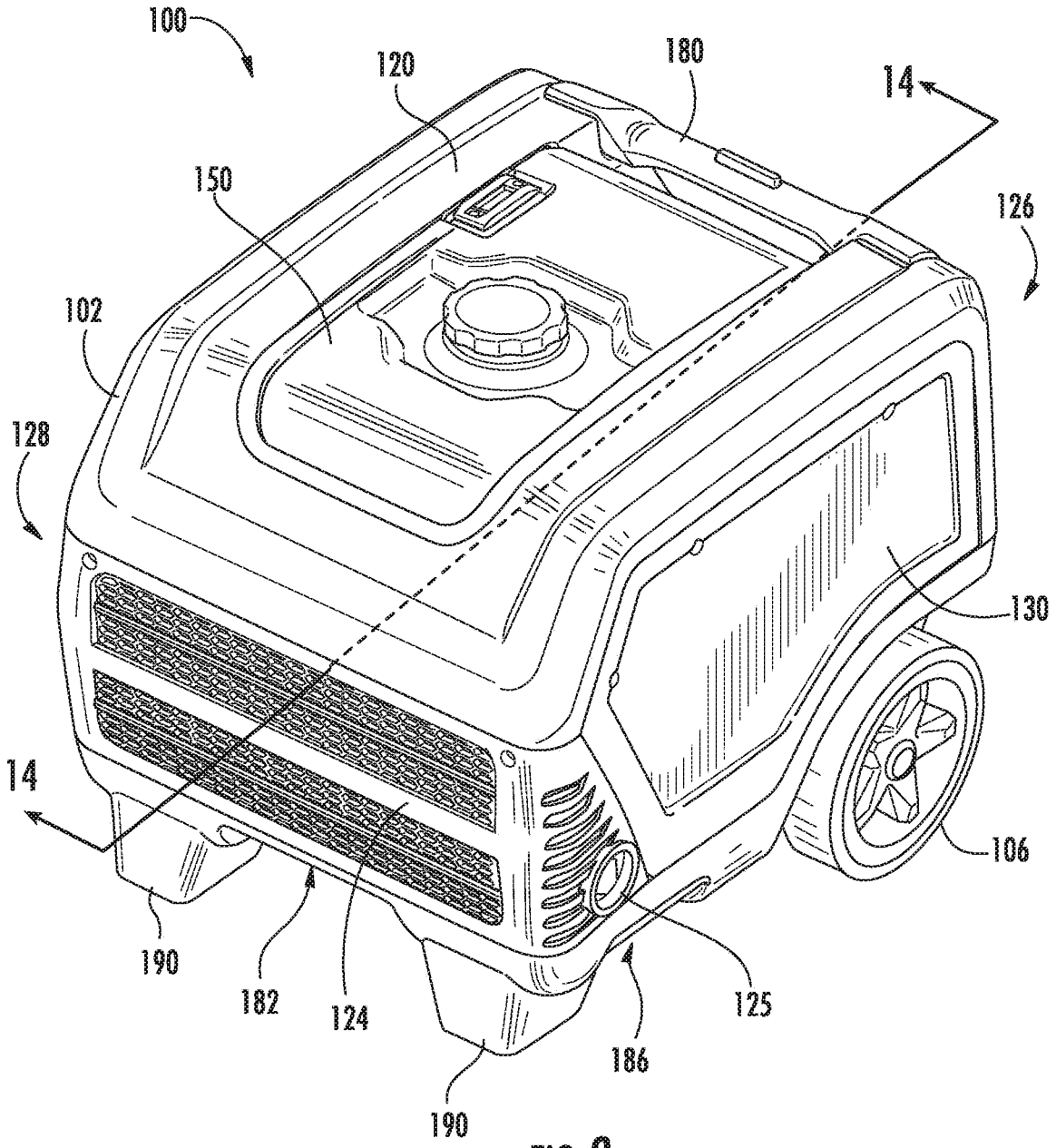
FIG. 3 is a left perspective view from above of the inverter generator of FIG. 1, according to an exemplary embodiment.

Referring to FIGS. 2-3, the muffler 160 includes an exhaust pipe 165 extending from the muffler 160 along muffler axis 121 terminating approximately at or beyond the housing 102 at an exhaust 125. The exhaust 125 is positioned on an opposite side of the generator 100 from the control panel 112. In the illustrated embodiments shown in FIG. 1-3, the exhaust 125 is positioned on the right side 130, while the control panel 112 is positioned on the left side 128 of the inverter generator 100. In other embodiments, the control panel 112 and/or exhaust 125 can be positioned on other sides of the generator 100. Positioning the exhaust 125 on an opposite side of the generator 100 from the control panel 112 reduces the amount of noise reaching a user while the user is operating the generator 100 from the control panel 112. The muffler exhaust 125 is centered around a muffler axis 121. The muffler axis 121 is substantially perpendicular (e.g., ±5 degrees) to the crankshaft axis 101. The muffler axis 121 is also substantially perpendicular to the left and right sides 128, 130. This orientation allows for the positioning of the muffler exhaust 125 as far as possible away from the control panel 112, where the user may be adjusting controls and starting or stopping the generator 100. This feature may provide a low-cost user experienced noise reduction over conventional generators.

Figure 4:
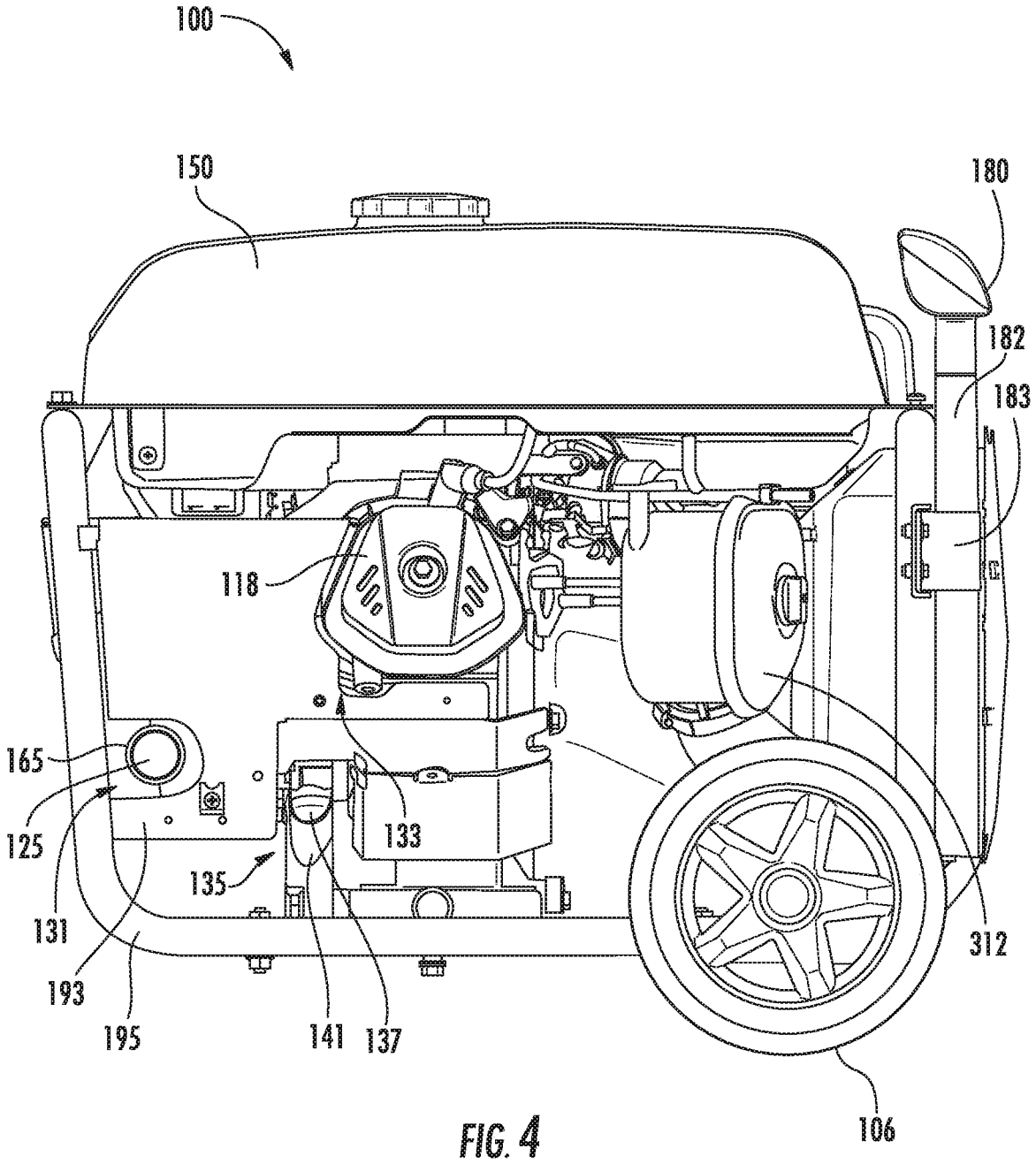
FIG. 4 is a left side view of the inverter generator of FIG. 1, according to an exemplary embodiment.
Figure 5:
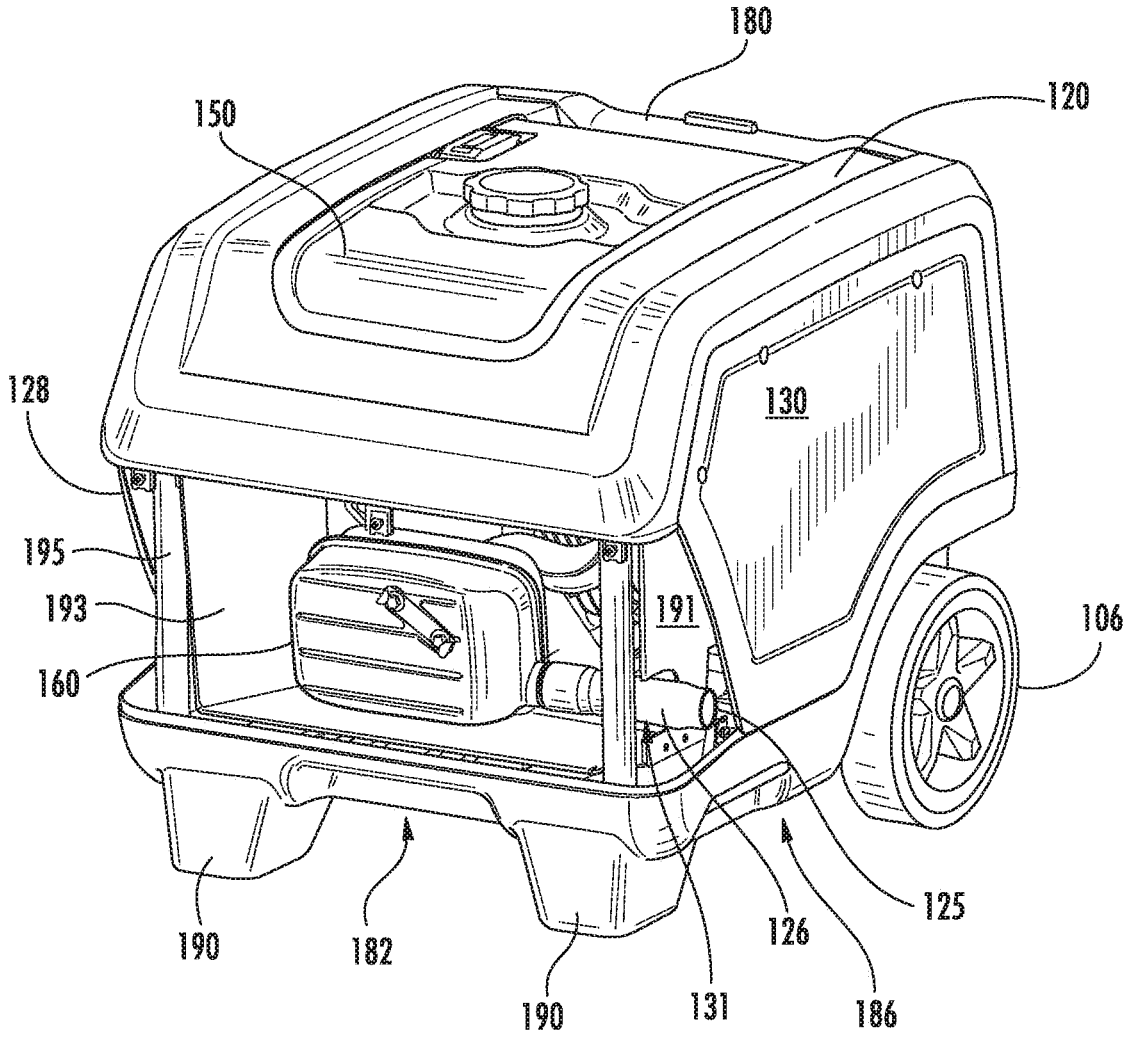
FIG. 5 is a perspective view of the inverter generator of FIG. 1, according to an exemplary embodiment.
Figure 6:
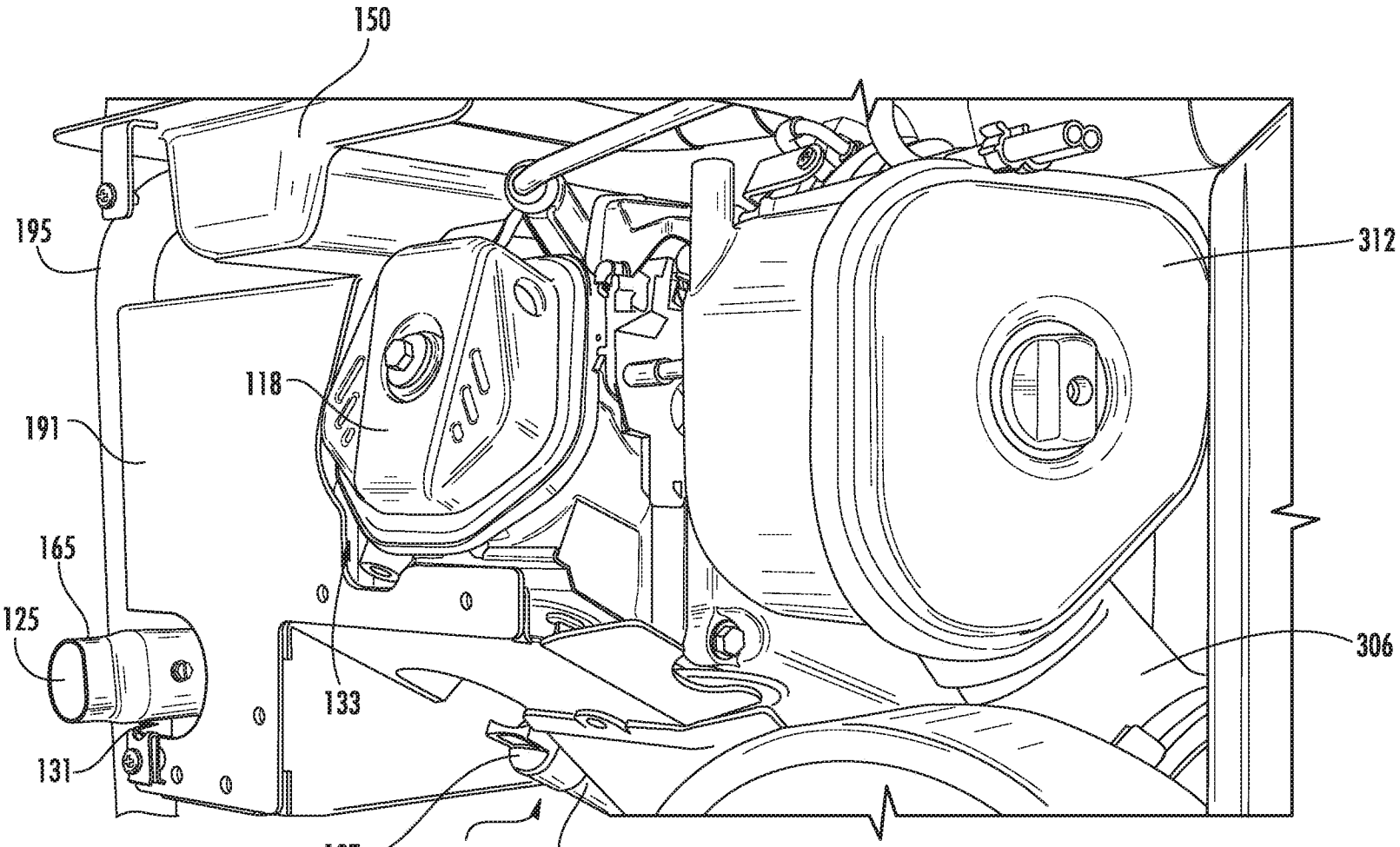
FIG. 6 is a rear-left perspective view of the inverter generator of FIG. 1, according to an exemplary embodiment.

Referring to FIGS. 4-6, the muffler 160 is partially surrounded (e.g., surrounded on all sides except near the front side 124 of the generator 100) by one or more heat shields 191, 193. The heat shields 191, 193 are positioned between the muffler 160 and the engine 110 and between the muffler 160 and the top 120, bottom 122, left 128, and right sides 130 of the generator 100, but not between the muffler 160 and the front side 124 of the generator 100. Accordingly, an open space 127 surrounds the muffler 160 proximate the front side 124. In other embodiments, the muffler 160 is entirely surrounded by heat shields or the muffler 160 is open to another side of the generator 100. The heat shields 191, 193 create a heat barrier between the engine 110 and the muffler 160. In this way, heat radiating from the muffler 160 does not reach the engine 110. In particular, heat radiating from the muffler 160 will not reach the engine crankshaft oil seal, potentially causing damage to the seal and resulting in further wear on the engine 110. The heat shields 191, 193 also act to reduce sound emitted from the muffler 160. The muffler 160 is not surrounded by heat shields 191, 193 near the front side 124 of the generator 100 (e.g., at open space 127) such that the muffler 160 is cooled using air entering through the front side 124. The heat shields 191, 193 are positioned such that exhaust exiting the muffler 160 at exhaust 125 does not mix with cooling air flowing through the components of the generator 100. The heat shields 191, 193 are also configured to allow for a first gap 131 to allow for a clearance between the heat shield 191 and exhaust 125 and a second gap 133 to allow for a clearance between the heat shield 191 and cylinder head 118. The gaps 131, 133 permit air flow around the heat shields 191, 193 and into the open space 127 surrounding the muffler 160 for further cooling of the muffler 160. The heat shield pieces 191, 193 are made of compressed fiberglass. In other embodiments, the heat shields 191, 193 are made from other insulating materials.

Referring to FIG. 4, an oil fill apparatus 135 including an oil fill cap 137 and an oil fill passage 141 is shown, according to an exemplary embodiment. The oil fill cap 137 can be removable coupled to the oil fill passage 141 through which oil may be poured down to the crankcase 113. The oil fill passage 141 extends a distance from the crankcase 113 such that the oil fill apparatus 135 is accessible for a user. The oil fill apparatus 135 is positioned on the same side of the generator 100 as the muffler exhaust 125. In other embodiments, the oil fill apparatus 135 is otherwise positioned.

Figure 7:
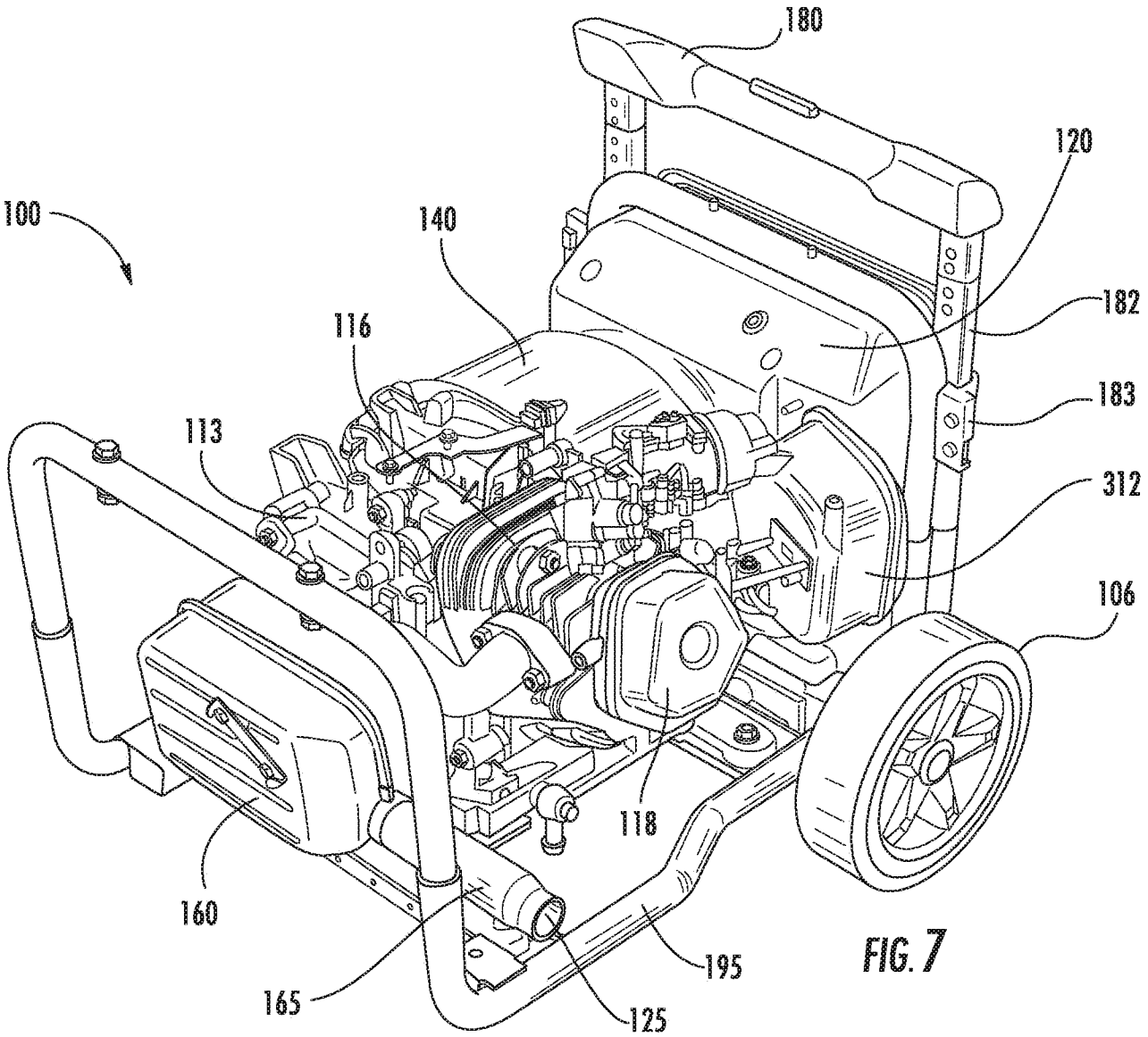
FIG. 7 is a left perspective view of the inverter generator of FIG. 1 with a housing removed, according to an exemplary embodiment.
Figure 8:
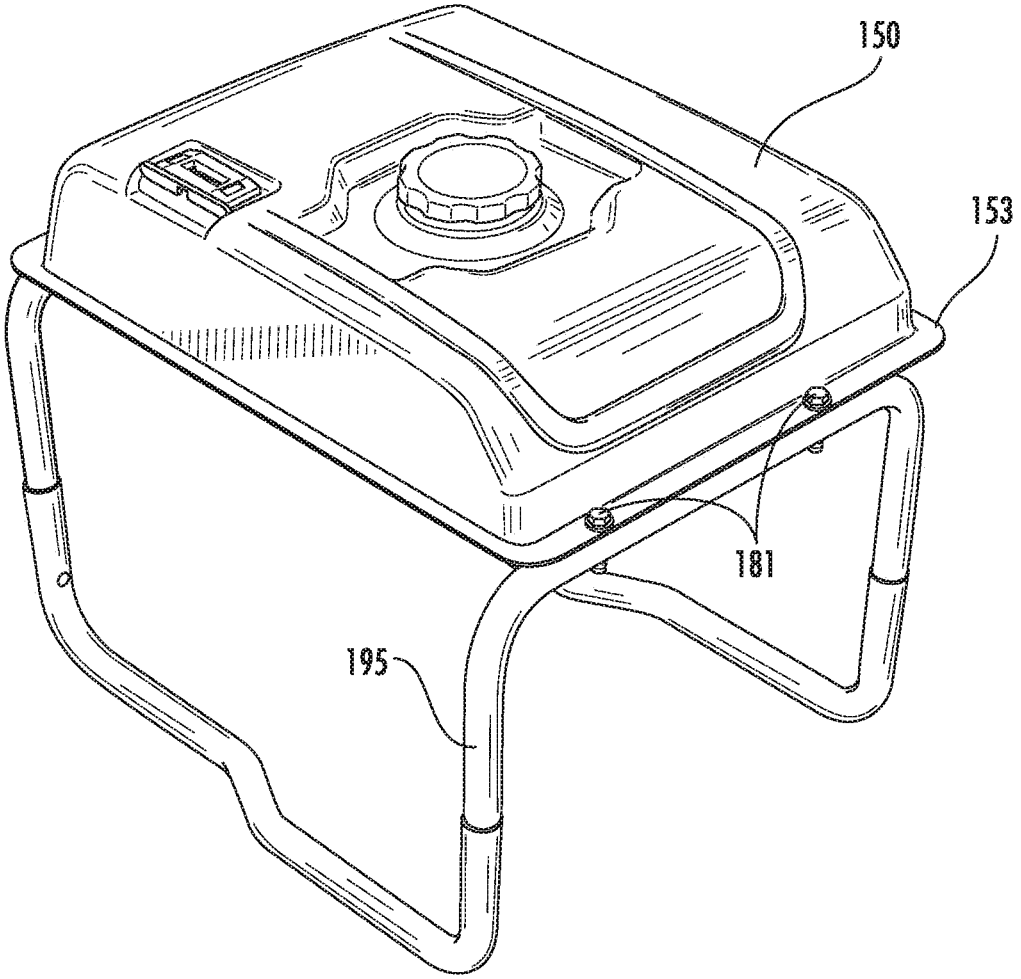
FIG. 8 is a perspective view of a frame and fuel tank of the inverter generator of FIG. 1, according to an exemplary embodiment.
Figure 9:
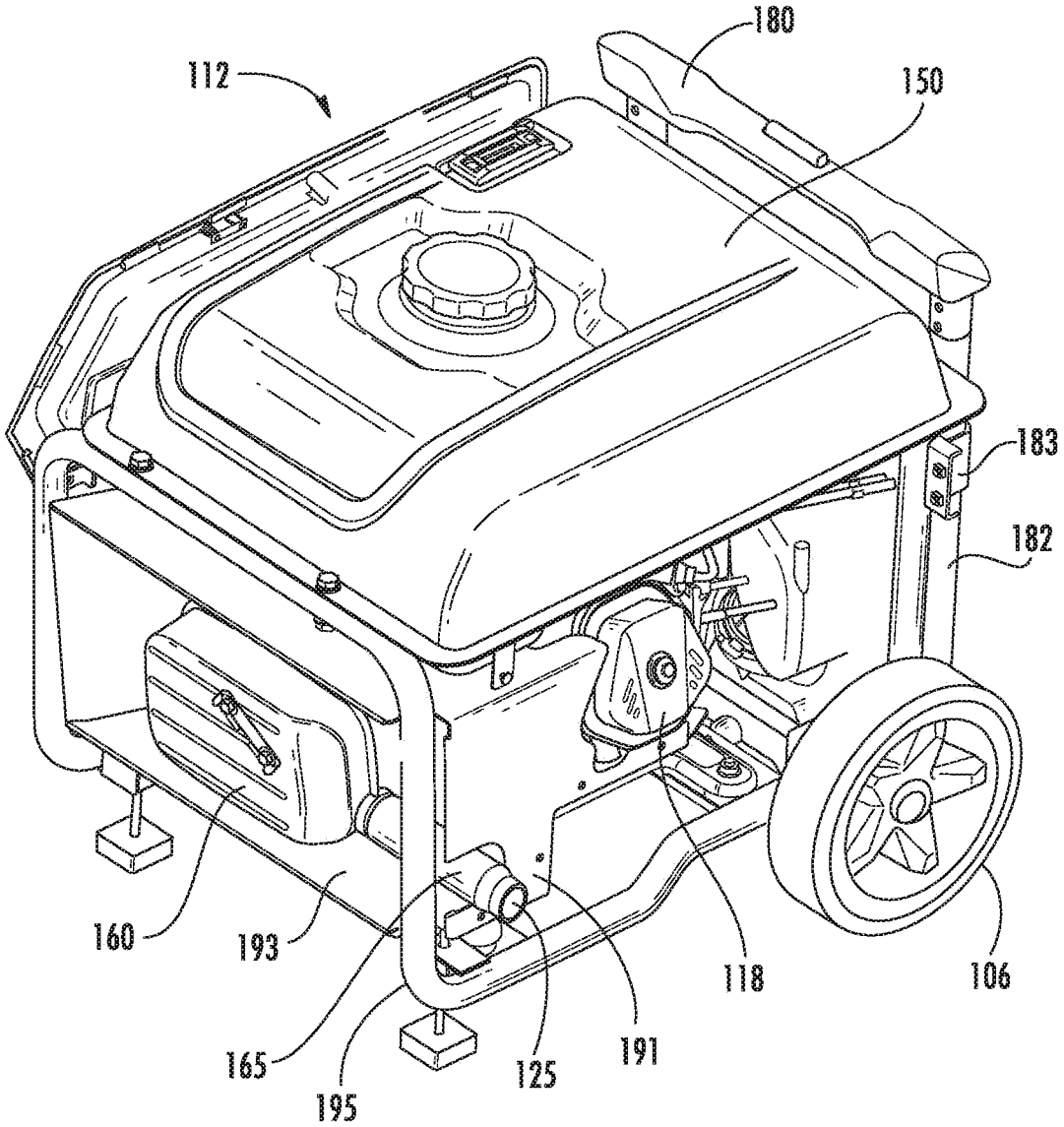
FIG. 9 is a perspective view of the inverter generator of FIG. 1 with the housing removed, according to an exemplary embodiment.

Referring to FIG. 7, a perspective view of the inverter generator 100 with housing 102 removed is shown, according to an exemplary embodiment. The inverter generator 100 includes an internal tubular frame 195 structured to simultaneously (and/or directly) support the inverter generator 100 and the components of the inverter generator 100. The internal tubular frame 195 can support all essential components of the generator 100 (e.g., rather than housing 102) such that the housing 102, including the bottom tray 104, can be removed without damaging the structural integrity of the generator 100. The engine 110, controller 123 including the inverter 129, alternator 140, and handle 180 are supported by the frame 195. In some embodiments, heat shield pieces 191, 193 are additionally supported by frame 195 (shown in FIG. 9). Referring to FIG. 8, the fuel tank 150 is additionally supported by the frame 195. The fuel tank 150 includes a flange 153 which attaches to the frame 195 at fastener locations 154 with fasteners 181, enabling support of the inverter generator 100 without frame cross members. The fuel tank 150 may serve as part of the structure of the frame 195. Conventional generators may include a fuel tank supported only by a housing or other piece. Additionally, conventional generators may include components (e.g., engine, controller, fuel tank) supported by separate support structures and not by a common frame.

The internal tubular frame 195 is configured to reduce the overall weight of the inverter generator 100. For example, the inverter generator may weigh under 150 pounds with the product packaging, which allows a single unit to be shipped via United States Postal Service. Using the fuel tank 150 as part of the structure for the internal tubular frame 195 may also reduce the overall weight of the inverter generator 100. The internal tubular frame 195 may additionally preserve the appearance of the housing 102 of the inverter generator by hiding the frame 195 within the housing 102. Typical generators have an external/exposed tubular frame and do not provide the same type of appearance.

Figure 10:
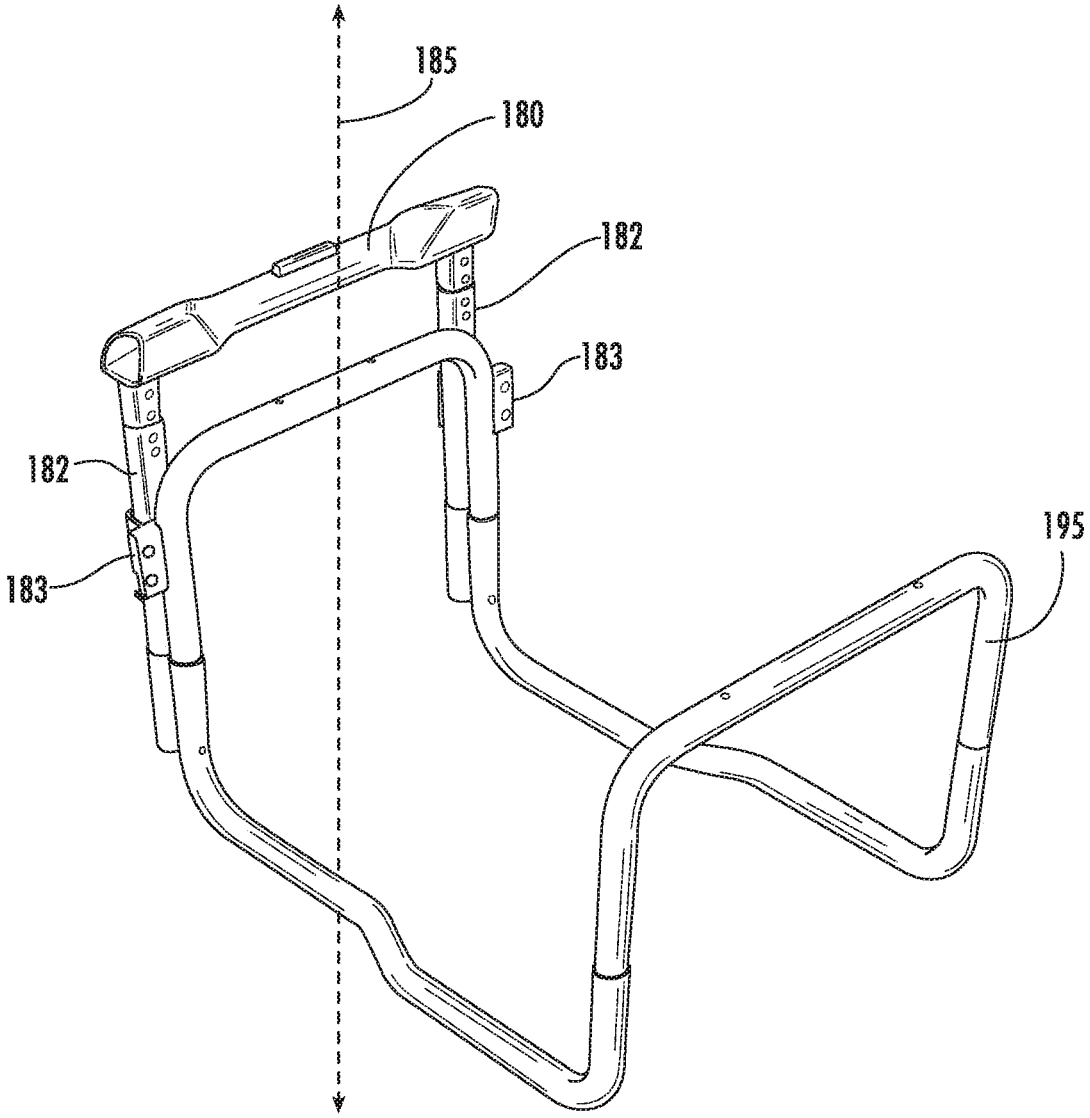
FIG. 10 is a perspective view of the frame and handle of the inverter generator of FIG. 1, according to an exemplary embodiment.

Referring to FIG. 10, a perspective view of the internal tubular frame 195 and a handle 180 is shown, according to an exemplary embodiment. The handle 180 includes legs 182 attached to the internal tubular frame 195 via mounts 183. In other embodiments, the handle 180 may be coupled otherwise to the inverter generator. The handle 180 is retractable and telescopic in nature. The handle 180 extends telescopically along at least a substantially vertical axis 185 (e.g., ±5 degrees) between a retracted position and an extended position. In some embodiments, one or more intermediary positions are included between the retracted and extended positions. In some embodiments, in an extended position, the handle 180 locks into place such that when a user lets go of the handle 180, the handle 180 remains in the extended position. The handle 180 can be used as storage for an electrical cord on the inverter generator, such that a user may wrap an electrical cord of the inverter generator around the handle 180.

Figure 11:
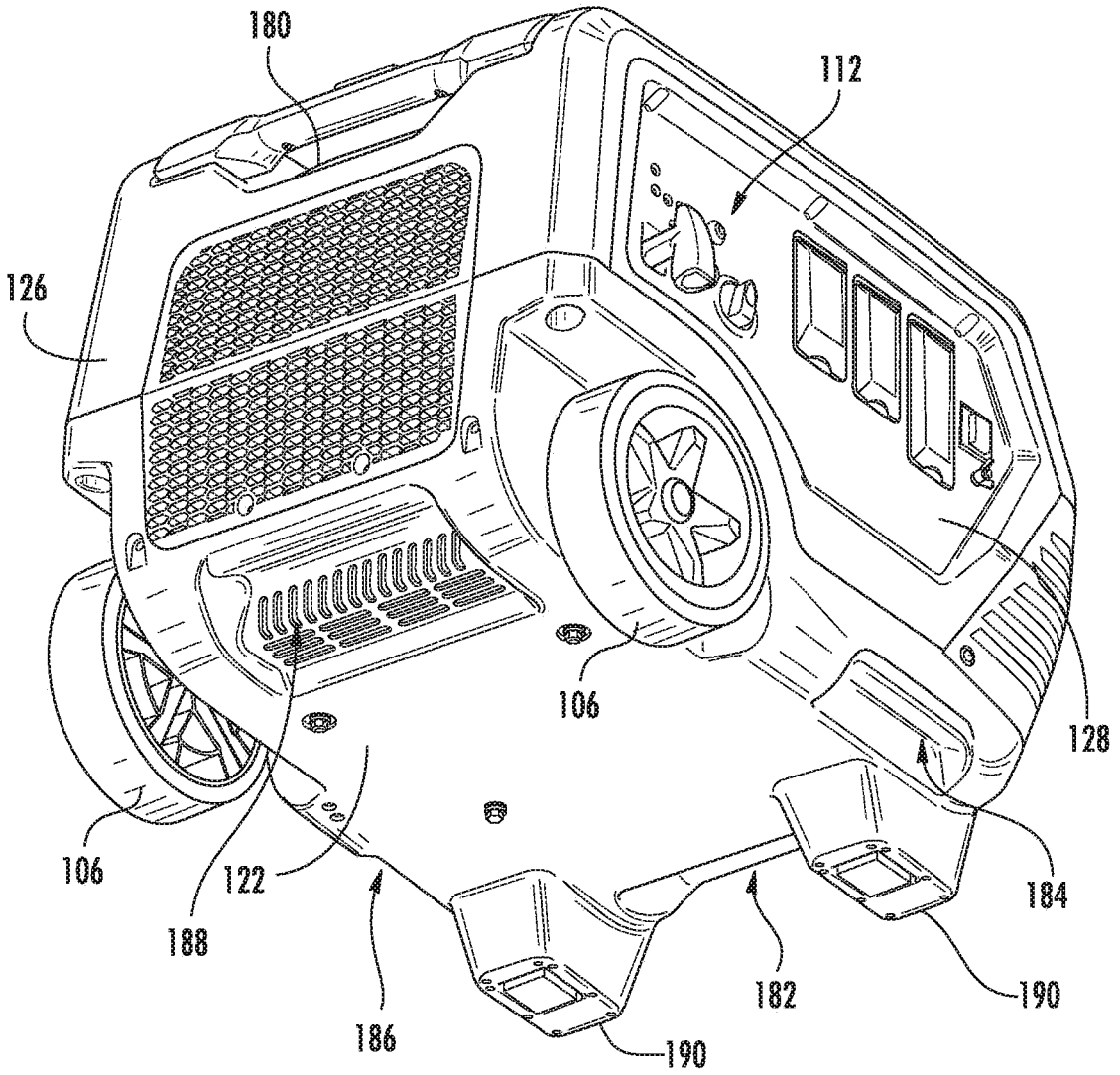
FIG. 11 is a perspective view from below of the inverter generator of FIG. 1, according to an exemplary embodiment.

Referring to FIG. 11, underside handles of the generator are shown, according to an exemplary embodiment. One or more underside handles (e.g., front underside handle 182, left underside handle 184, right underside handle 186, rear underside handle 188) are molded into the bottom tray 104 of the inverter generator 100. The underside handles may provide for relatively easy transport of the inverter generator, and in particular, allow for easy lifting of the generator 100.

Figure 12:
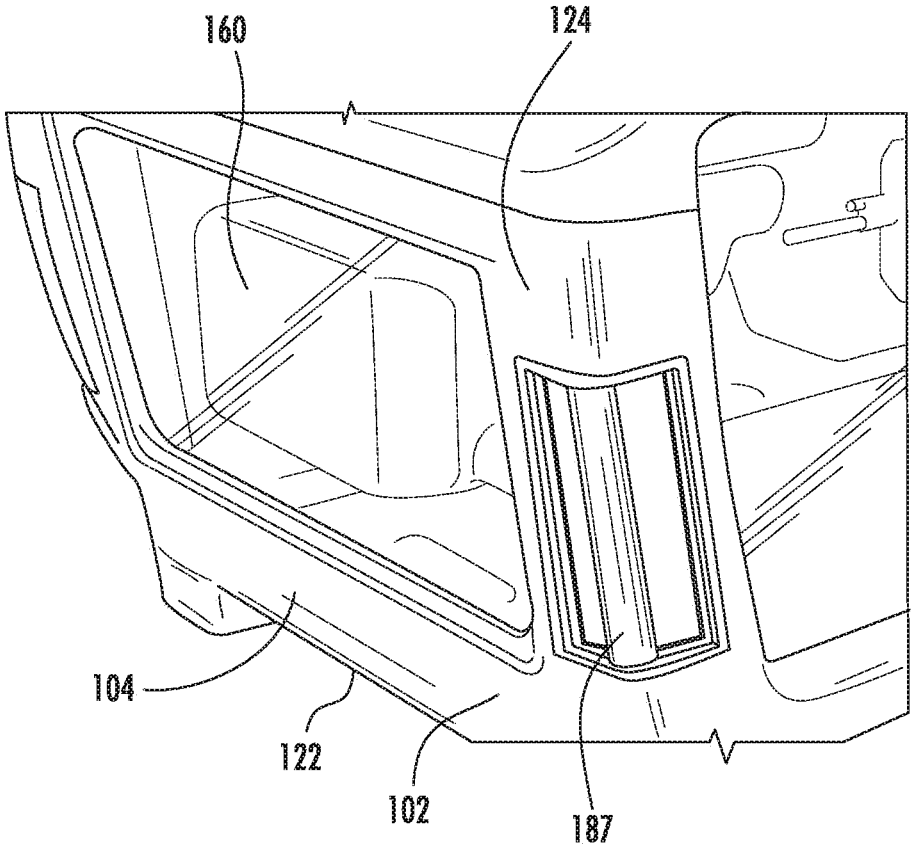
FIG. 12 is a perspective view of a handle of an inverter generator.
Figure 13:
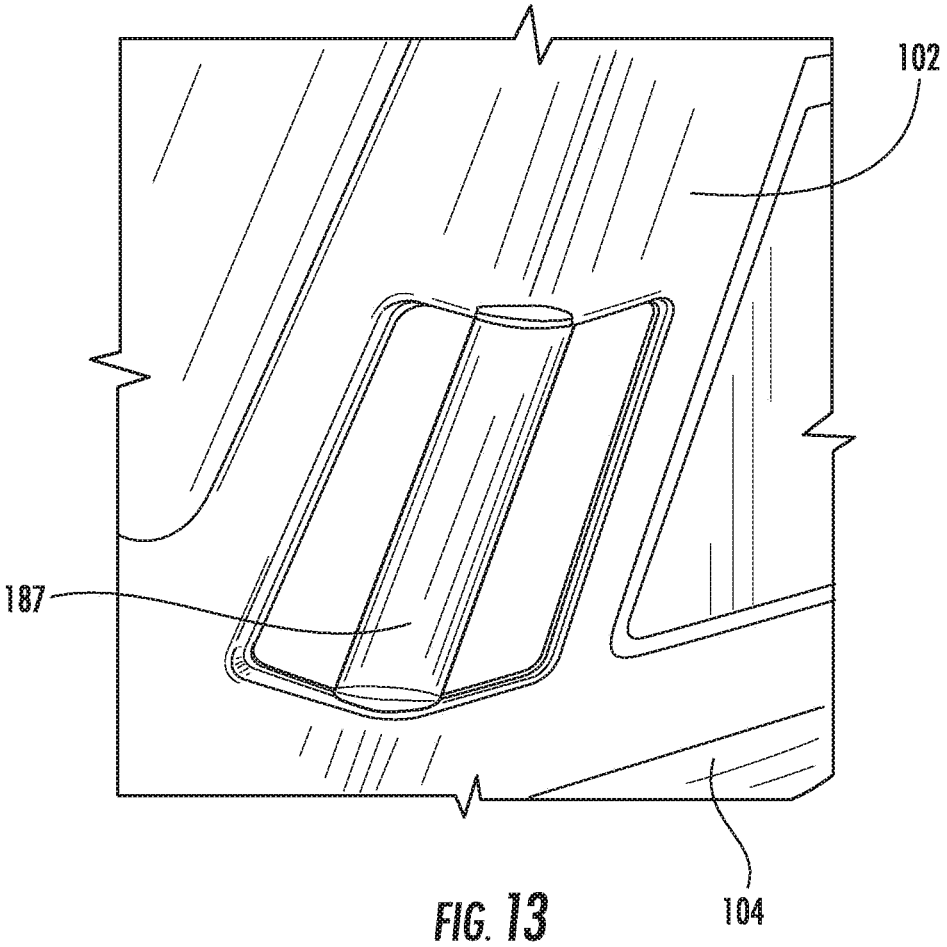
FIG. 13 is a perspective view of a handle of an inverter generator.

Referring to FIGS. 12, 13, another embodiment of a lifting handle is shown. The lifting handle 187 may extend from inside to outside the housing 102 and then reenter the housing 102. In some embodiments, the lifting handle 187 may be tubular in shape. A user may grip the lifting handle 187 to move the inverter generator. In some embodiments, there may be a pair of lifting handles 187 on each side of the inverter generator. The lifting handle 187 is an exposed portion of the internal tubular frame 195 shown in FIGS. 7-10. The lifting handle 187 may be positioned on or near the bottom tray 104 of the inverter generator. As shown in FIG. 12, the lifting handle 187 may be positioned on the front side 124 and on or near where the bottom side 122 of the generator 100 meets the front side 124.

Figure 14:
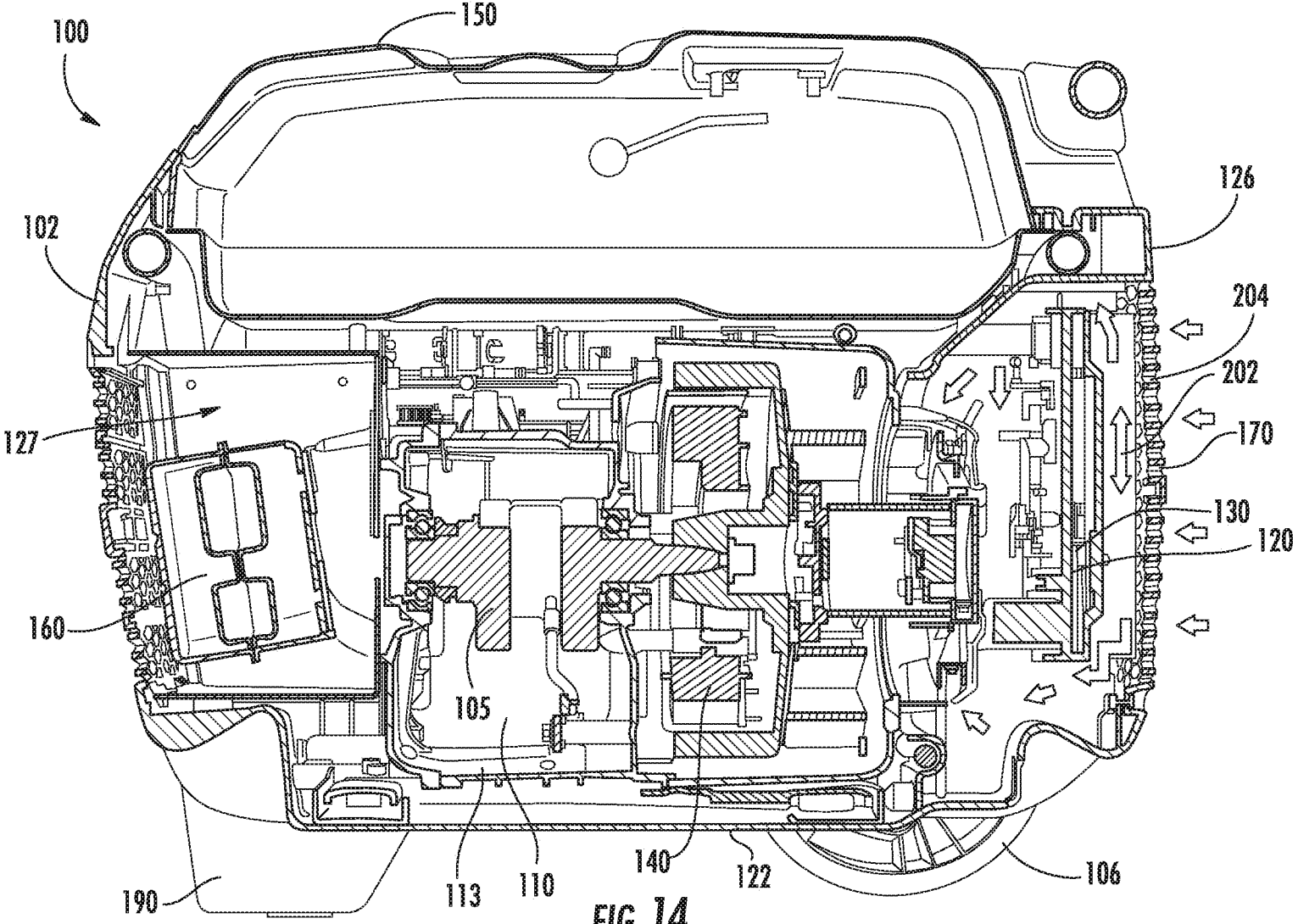
FIG. 14 is a section view of the inverter generator of FIG. 3 along section line 14-14, according to an exemplary embodiment.

Referring to FIG. 14, a diagram of an airflow path 202 is shown according to an exemplary embodiment. The airflow path 202 is formed within the inverter generator 100. One or more conduits 204 are formed on the rear 130 of the inverter generator 100, which allow air to flow into the generator. The airflow path 202 extends into the generator 100 and allows air to flow past the fins of the controller 123 and under the bottom of the controller 123. The airflow path 202 additionally extends into the engine 110 of the generator 100, serving to cool the engine 110. The controller 123, which includes the inverter 129, is positioned directly in the incoming airflow path 202, such that the inverter 129 is cooled.

Figure 15:
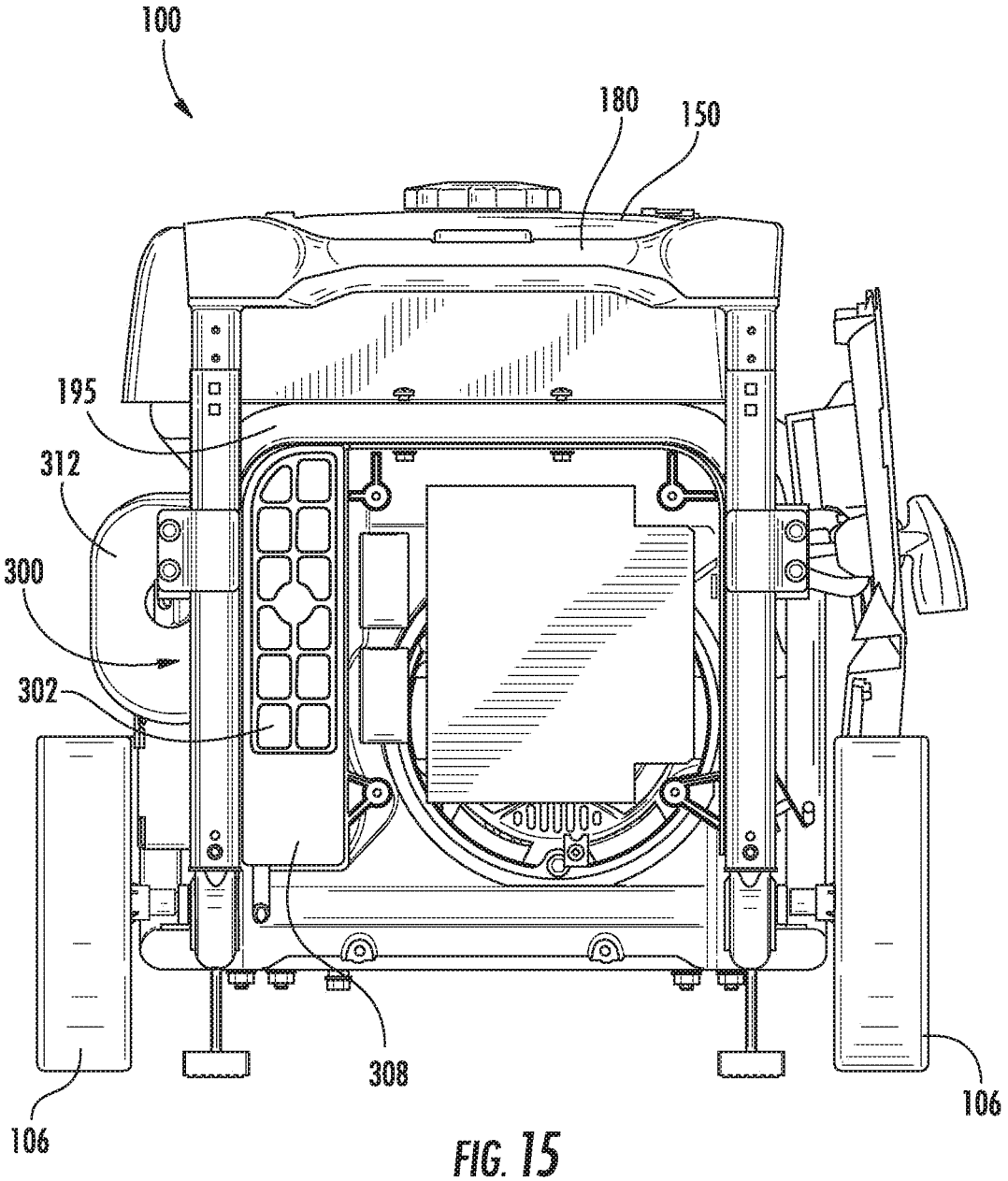
FIG. 15 is a rear view of the inverter generator including an air tube configuration, according to an exemplary embodiment.
Figure 16:
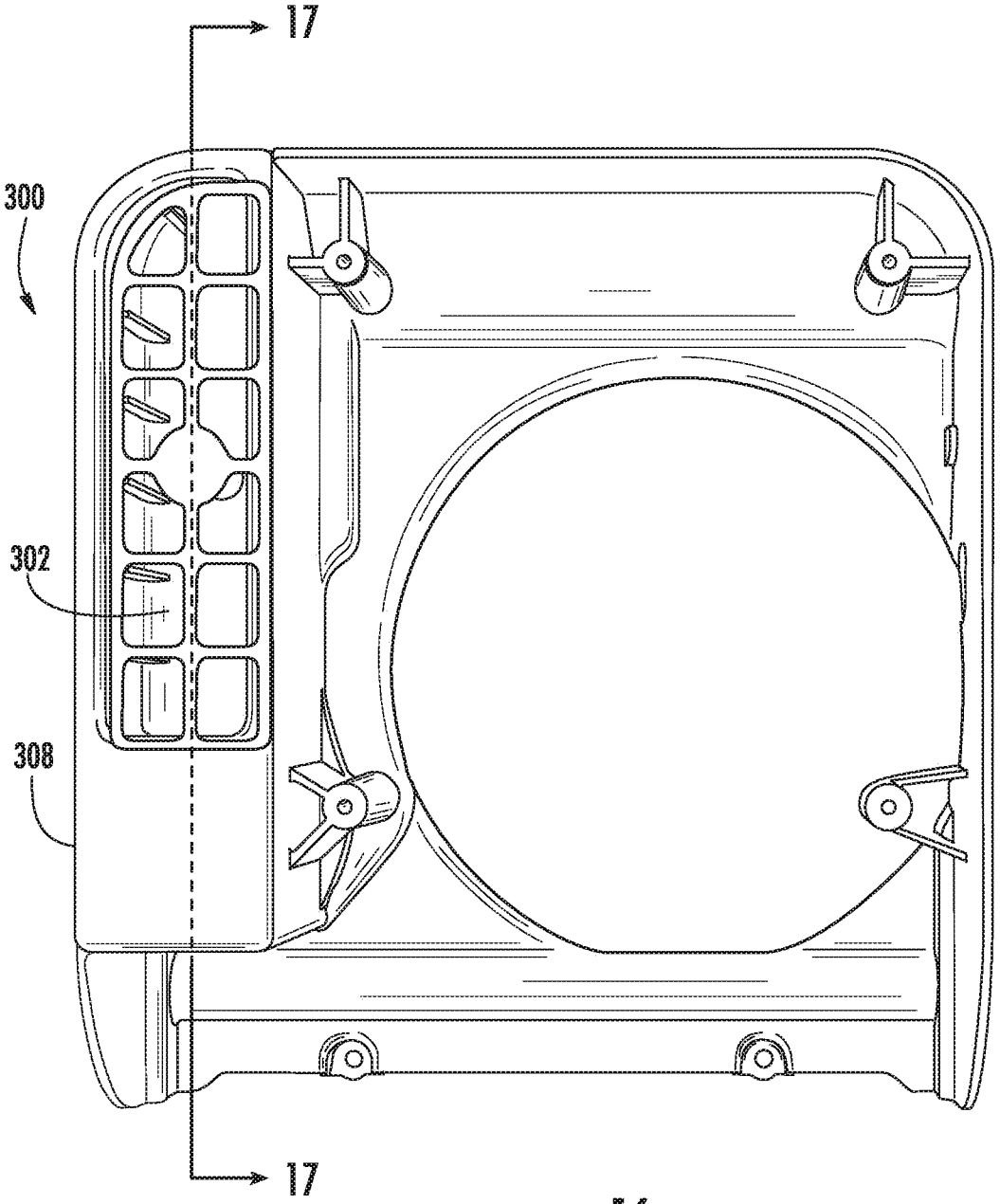
FIG. 16 is a rear view of the air tube configuration of FIG. 15, according to an exemplary embodiment.
Figure 17:
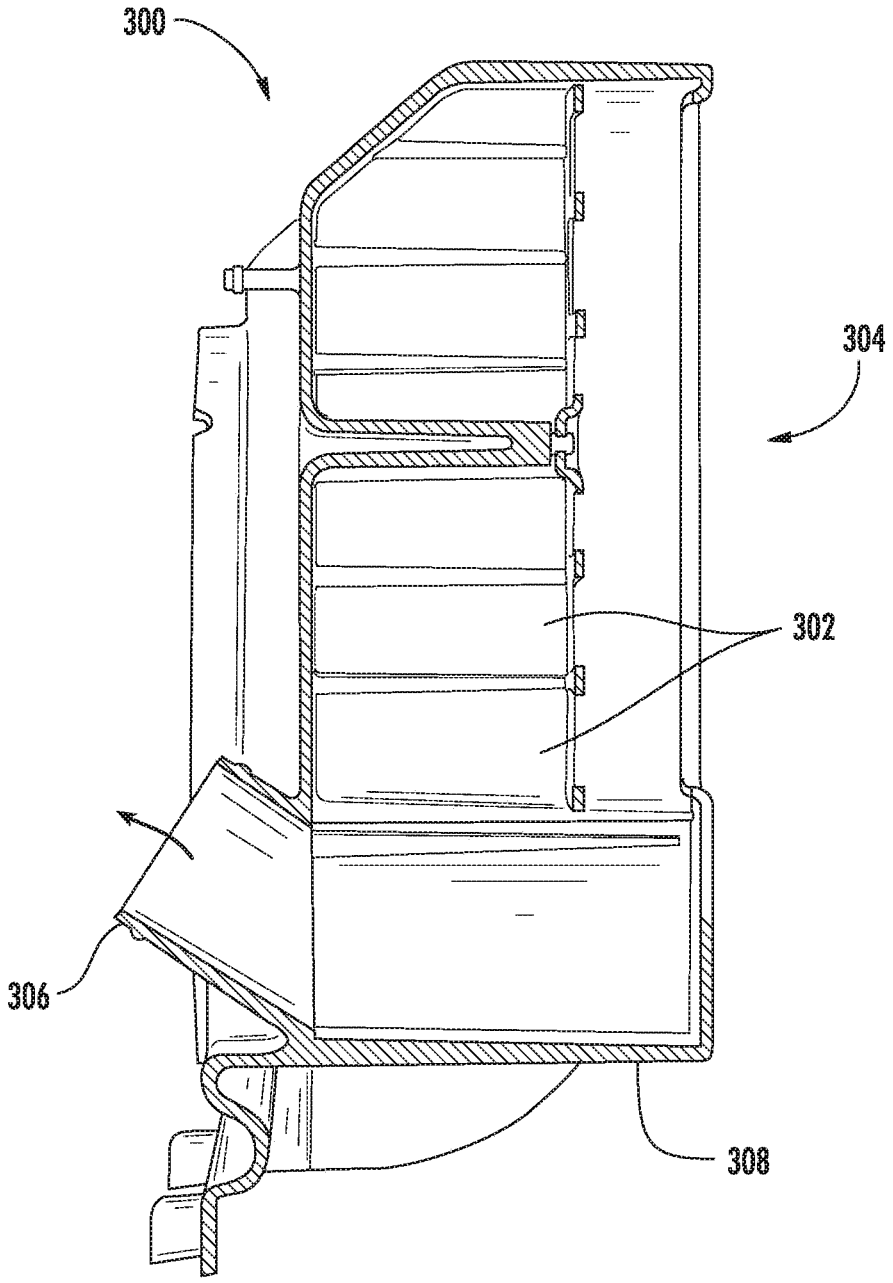
FIG. 17 is a section view of the air tube configuration of FIG. 15 along section line 17-17, according to an exemplary embodiment.

Referring to FIGS. 15-17, an air tube configuration 300 is shown, according to an exemplary embodiment. The air tube configuration 300 is positioned on the rear 130 of the generator 100. The air tube configuration 300 includes one or more resonator chambers 302 positioned inside a resonator box 308. The resonator chambers 302 are structured to attenuate (e.g., reduce, cancel out) sound emitting from the generator 100. The resonator chambers 302 emit a sound wave with an inverted phase relative to the sound waves produced by the engine 110 and/or muffler 160. By causing opposite moving sound waves to interfere with one another, the sound produced from the generator 100 is attenuated. In operation, air moves into an air inlet 304, across the resonator chambers 302, and exits the resonator box 308 through the air outlet 306. An air tube may be attached to the air outlet 306 such that the exiting air moves through the expansion chamber 312 (shown in FIG. 4) and into an air-fuel mixing device. Varying lengths and different shapes for the one or more resonator chambers 302 may be used to create different tones, which may be used to cancel out the tone emitted from the inverter generator. In some embodiments, the air tube configuration 300 includes Helmholtz resonators. In some embodiments, the air tube configuration 300 is structured to create a tone such that the sound from other components in the inverter generator is cancelled out or at least reduced. In some embodiments, the air tube configuration 300 is tuned in accordance with the design of the inverter generator. In other embodiments, the air tube configuration 300 is variable in nature such that each inverter generator may be custom tuned.

Figure 18:
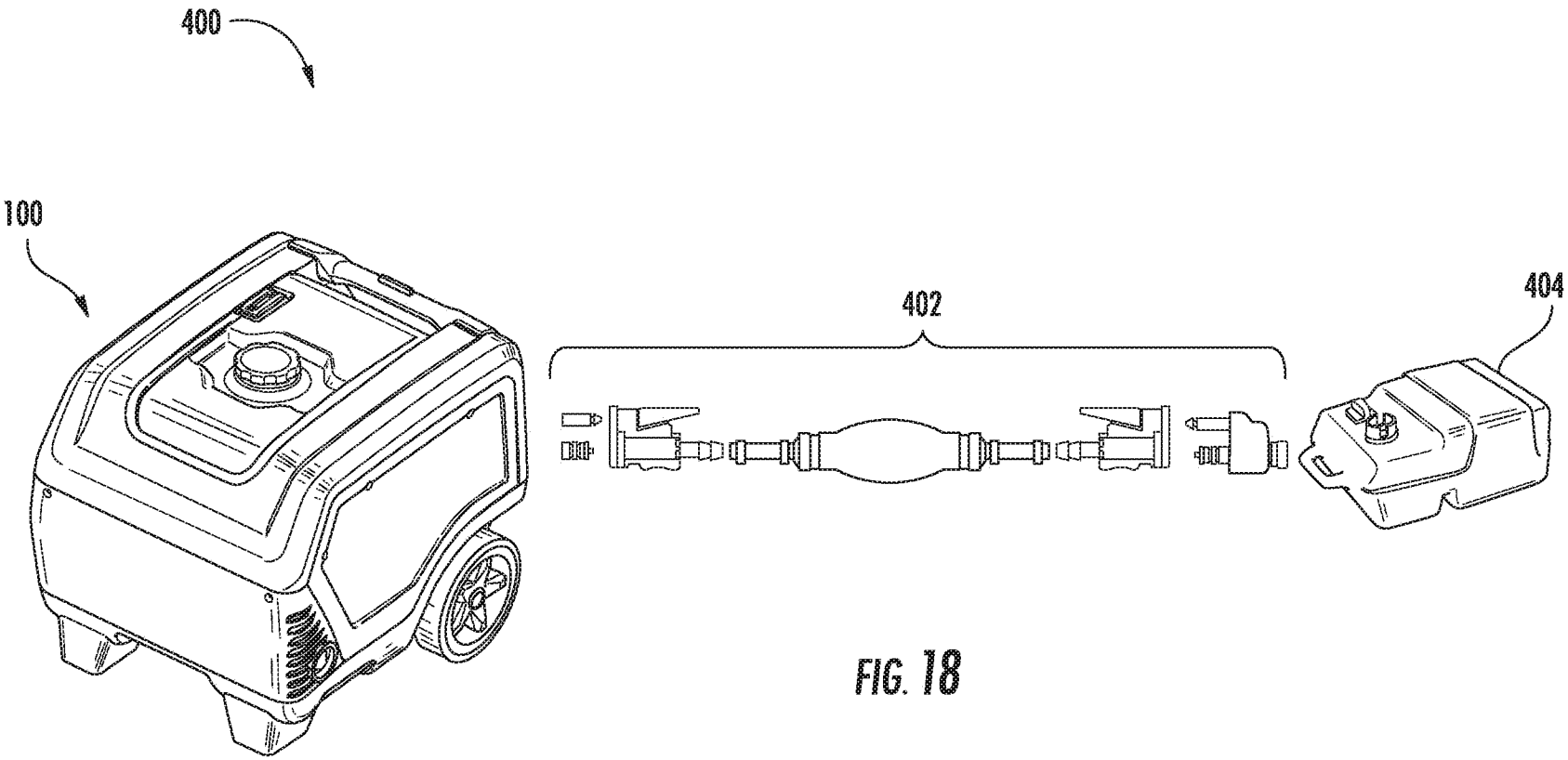
FIG. 18 is a perspective view of a fuel tank adapter.

Referring to FIG. 18, a diagram of a fuel tank adapter system 400 is shown. The fuel tank adapter system 400 includes a fuel tank adapter 402. In some embodiments, a fuel tank adapter system 400 can be used in connection with the inverter generator 100. The fuel tank adapter 402 couples to an external fuel tank 404, such as a marine fuel tank, to the inverter generator. Portable marine fuel tanks used in the boating industry may be used in connection with the inverter generator to provide an additional fuel source. Using the fuel tank adapter 402, a user may use the additional fuel tank 404 to fuel the inverter generator 100. This may be especially important in areas where fuel access is limited.

Figure 19:
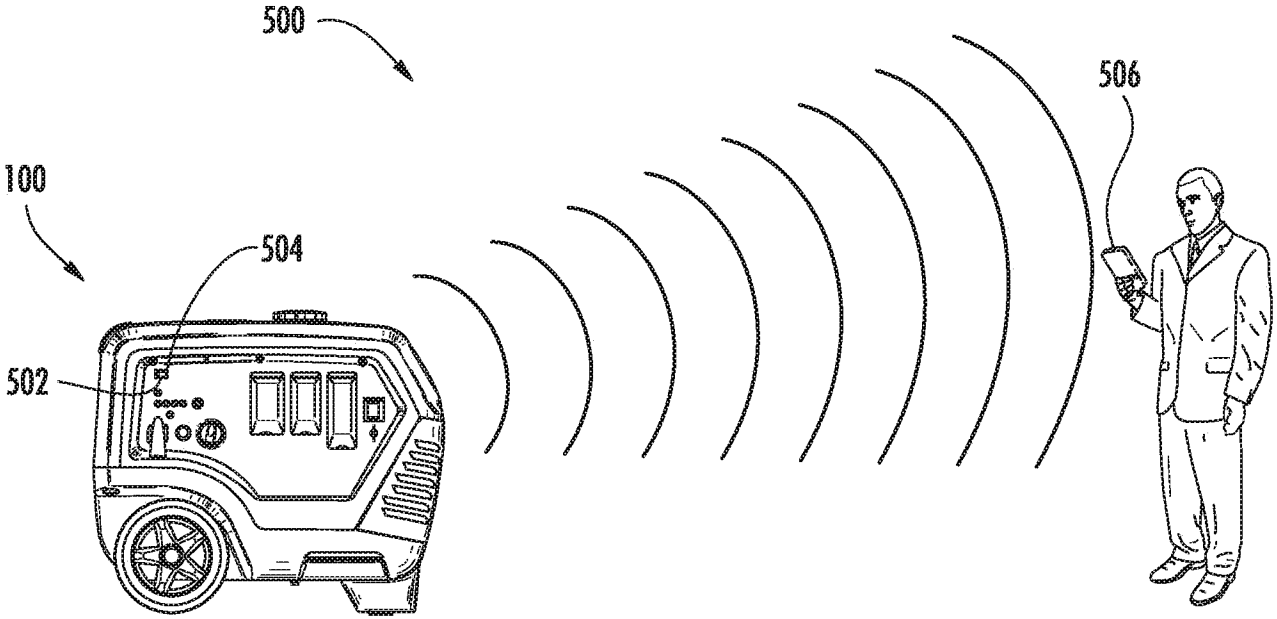
FIG. 19 is a diagram of a monitoring system.

Referring to FIG. 19, a diagram of a monitoring system 500 is shown. In some embodiments, a monitoring system 500 can be used to remotely monitor the generator 100. The monitoring system 500 includes a dongle 502 (e.g., a Universal Serial Bus (USB)) and a port 504, where the dongle 502 is communicably and operatively coupled to the port 504 such that the dongle 502 is in communication with the port 504, and thus with the inverter generator 100. The port 504 may be positioned on or near the control panel 112 of the inverter generator 100. The monitoring system 500 may further include a mobile device 506. The mobile device 506 may be one of a user of the inverter generator 100. The mobile device 406 may include any type of wearable device including, but not limited to a smartphone, a smart watch, a smart bracelet, and/or any other wearables. The mobile device 506 may also include any other type of computing device (e.g., tablet computer, desktop computer, etc.). The mobile device 506 may include a network interface and one or more processing components for processing received and/or provided instructions, and any other component or device typically included with a mobile device and/or computing device. The mobile device 506 may include logic disposed within memory and executable by a processor to perform various operations described herein. The memory may also store various applications, such as a mobile application provided with the dongle 502 that facilitates communication between the mobile device 506 and the inverter generator 100 via the dongle 502. The mobile device 506 may further include a display device (e.g., a screen) and one or more input/output devices (e.g., a touch screen, microphone, speaker, keyboard, etc.).

Still referring to FIG. 19, the dongle 502 is structured to communicate with the mobile device 506. The dongle 502 and the mobile device 506 may communicate via a wireless connection (e.g., Bluetooth, WiFi, ZigBee). In another embodiment, the dongle 502 and mobile device 506 may communicate via a wired connection. The dongle 502 may provide information for display on the mobile device 506 and/or an application on the mobile device 506. Such information may include, but is not limited to, a status, run time, voltage, current, and other data relating to the inverter generator 100. In another embodiment, the inverter generator 100 may have wireless communication ability. In such a configuration, the dongle 502, if placed in the port 504, may be configured to prompt a mobile device 506 of a user for a code or other unlocking mechanism to begin operation and initiate communication with the mobile device 506.

In some embodiments, the dongle 502 may be capable of providing additional upgrade features to the inverter generator 100. As an example, the dongle 502 may provide a firmware upgrade to boost the power output of the inverter generator 100 by changing operating parameters, such as target engine speed. Further, the dongle 502 may provide a firmware upgrade to turn the alternator of the inverter generator 100 into an electric start motor and the dongle 502 may add parallel capability to the inverter generator 100.

Figure 20:
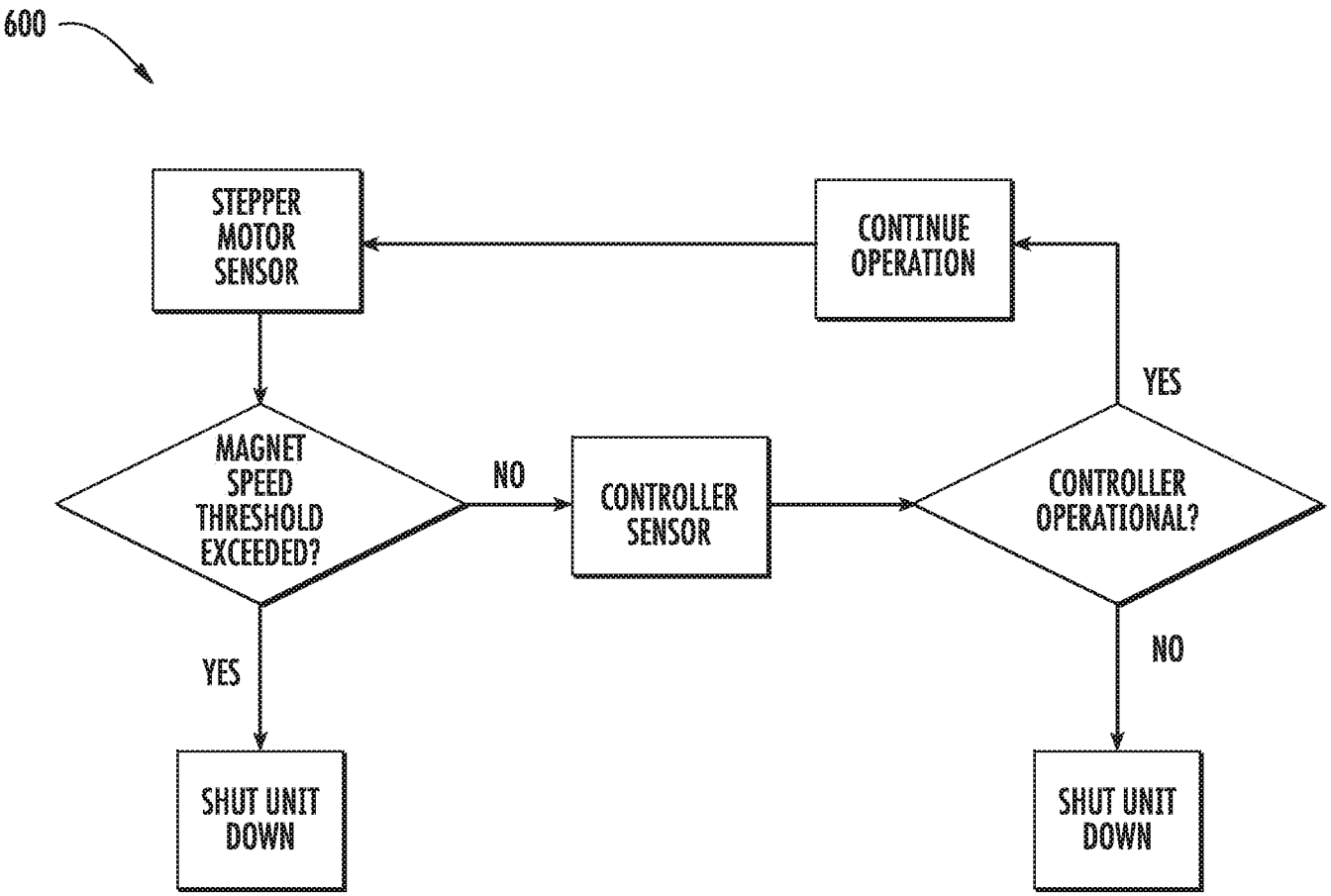
FIG. 20 is a diagram of an ignition module system.

In some embodiments, the inverter generator 100 includes an ignition module system 600. Referring to FIG. 20, a flow diagram of an ignition module system 600 is shown. In system 600, an ignition module detects that the controller 123 is in an operational state or in a non-operational state. If the controller 123 is in an operational state, the ignition module allows the inverter generator 100 to run. If the controller 123 is in a non-operational state, the ignition module 600 detects the non-operational state and shuts down the inverter generator 100. The ignition module 600 monitors the speed of a magnet housing of the inverter generator 100 to determine that the controller 123 is operational or non-operational. If the speed of the magnet housing exceeds a certain threshold, the ignition module determines that the controller 123 is non-operational and shuts down the inverter generator 100. Similarly, the system 600 may detect that the stepper motor has lost its reference point. As an example, the system 600 may detect that the stepper motor is controlling the throttle position in a way that is indicative of the stepper motor being at the wrong reference point in regard to the speed of the engine. The system 600 may detect the problem and proceed to shut down the unit.

In some embodiments, the inverter generator 100 is structured to automatically enter idle-down mode when no load is sensed. In some further embodiments, when a minimal load is sensed, the engine speed may increase to a relatively low engine speed (e.g., 2200 rpm). As an example, low load devices may include mobile phones, tablets, and any other mobile or hand-held devices. If, for instance, a mobile phone is plugged into the inverter generator 100 to charge, the load sensed would be relatively low and thus, the engine speed may be increased only slightly. Further, the inverter generator 100 may be structured to be operate at a low engine speed (e.g., 1800 rpm) and if a current draw is sensed that would require the engine 110 to speed up too quickly, the controller 123 shuts off the electrical output, waits for the engine 110 to speed up to the desired speed and then turns the electrical output back on. Additionally, more capacitors may be added to the inverter generator 100 to facilitate the transition between operational modes.

In some embodiments, the inverter generator 100 may utilize variable spark timing. A variable spark timing system includes a controller 123, an alternator 140, stepper motor, and various sensors (e.g., current sensor, voltage sensor, engine speed sensor). When the inverter generator 100 is at a no-load stage, the spark timing system may cause the spark timing to be slowed as the throttle is closed by the stepper motor to decrease the engine speed. When the inverter generator 100 is experiencing a high load, the output voltage may reduce, which may prompt the controller 123 to open the throttle on the carburetor via the stepper motor to increase the engine speed. The spark may be advanced further by the controller 123 such that the spark timing results in optimal power for the engine speed. The increase in the engine speed may cause the permanent magnets of the alternator 140 to spin at a higher rate, which may result in greater electrical output of the alternator 140. Optimizing the spark timing to the engine speed may increase the power output of the inverter generator.

In some embodiments, the controller 123 provides control of an electric heating system on the inverter generator 100. The electric heating system may facilitate prevention of icing on the inverter generator 100.

The construction and arrangements of the inverter generator, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An inverter generator comprising:

an elongated tubular frame;

an internal combustion engine attached to the elongated tubular frame;

an alternator attached to the tubular frame, connected to the internal combustion engine, and configured to produce electricity:

a fuel tank including a flange, wherein the fuel tank is attached to the elongated tubular frame by the flange:

a housing attached to the tubular frame, wherein the elongated tubular frame is hidden within the housing: and wherein the elongated tubular frame is configured to simultaneously support the internal combustion engine, the alternator, and the fuel tank such that the housing can be removed without damaging the structural integrity of the inverter generator;

an electrical outlet; and a controller comprising an inverter, the inverter configured to receive electrical power from the alternator and provide an electrical output to the electrical outlet;

wherein the controller is configured to temporarily suspend the electrical output to the electrical outlet at a first speed of the engine and turns on the electrical output after a second speed of the engine is attained;

wherein the second speed is more than the first speed.

2. The inverter generator of claim 1, further comprising a muffler including a muffler pipe extending along a muffler pipe axis and terminating at a muffler exhaust; wherein the muffler pipe axis is substantially perpendicular to the crankshaft axis.

3. The inverter generator of claim 1, further comprising:

a telescoping handle attached to and supported by the elongated tubular frame, wherein the telescoping handle is configured to move between an extended position and a retracted position.

4. The inverter generator of claim 3, wherein the telescoping handle is configured to extend and retract along a substantially vertical axis.

5. The inverter generator of claim 1, further comprising a muffler including a muffler pipe extending along a muffler pipe axis and terminating at a muffler exhaust;

wherein the housing further comprises a control panel positioned opposite the muffler exhaust on the housing.

6. The inverter generator of claim 1, further comprising a muffler including a muffler pipe extending along a muffler pipe axis and terminating at a muffler exhaust;

wherein the muffler pipe axis is substantially perpendicular to the right side and the left side of the housing.

7. The inverter generator of claim 1, further comprising a heat shield configured to create a barrier between the engine and the muffler, the heat shield attached to the elongated tubular frame, wherein the heat shield partially surrounds the muffler.

8. The inverter generator of claim 1, further comprising an air resonator configured to reduce the sound of the inverter generator, the air resonator comprising:

a plurality of resonator chambers;

an air inlet configured to excite the plurality of resonator chambers; and an air outlet coupled to an air cleaner of the engine;

wherein flow of air from the air inlet through the plurality of resonator chambers emits a canceling tone.

9. The inverter generator of claim 1, further comprising a controller including an inverter configured to invert direct current into alternating current;

wherein the controller and the inverter are at least partially positioned in an incoming air flow path; and wherein incoming air flows around at least three sides of the controller.

10. An inverter generator comprising:

an internal combustion engine comprising:

an engine block including a cylinder;

an alternator connected to the internal combustion engine;

a crankshaft configured to rotate about a crankshaft axis;

a muffler including a muffler pipe extending along a muffler pipe axis and terminating at a muffler exhaust;

a first heat shield and a second heat shield each configured to create a barrier between the engine and the muffler, the first and the second heat shields attached to the elongated tubular frame, wherein the first and the second heat shields partially surrounds the muffler, and wherein the first heat shield includes a first gap between the first heat shield and the muffler exhaust and a second gap between the first heat shield and the cylinder:

wherein the muffler pipe axis is substantially perpendicular to the crankshaft axis;

an electrical outlet; and a controller comprising an inverter, the inverter configured to receive electrical power from the alternator and provide an electrical output to the electrical outlet;

wherein the controller is configured to temporarily suspend the electrical output to the electrical outlet at a first speed of the engine and turns on the electrical output after a second speed of the engine is attained;

wherein the second speed is more than the first speed.

11. The inverter generator of claim 10 further comprising:

a fuel tank positioned on a top side of the inverter generator;

an elongated tubular frame attached to the engine and the fuel tank; wherein the elongated tubular frame is configured to simultaneously support the engine and the fuel tank.

12. The inverter generator of claim 11, further comprising:

a telescoping handle attached to and supported by the elongated tubular frame, wherein the telescoping handle is configured to move between an extended position and a retracted position.

13. The inverter generator of claim 12, wherein the telescoping handle is configured to extend and retract along at least a vertical axis.

14. The inverter generator of claim 11, further comprising:

a housing attached to and surrounding the elongated tubular frame, wherein the housing comprises a front, a rear, a top, a bottom, a right side, and a left side.

15. The inverter generator of claim 14, wherein the housing further comprises a control panel positioned opposite the muffler exhaust on the housing.

16. The inverter generator of claim 14, wherein the muffler pipe axis is substantially perpendicular to the right side and the left side of the housing.

17. The inverter generator of claim 10, further comprising an air resonator configured to reduce the sound of the inverter generator, the air resonator comprising:

a plurality of resonator chambers;

an air inlet configured to excite the plurality of resonator chambers; and an air outlet coupled to an air cleaner of the engine;

wherein flow of air from the air inlet through the plurality of resonator chambers emits a canceling tone.

18. An inverter generator comprising:

an internal combustion engine comprising:

an engine block including a cylinder;

a crankshaft configured to rotate about a crankshaft axis;

an alternator comprising a rotor and a stator, the rotor configured to rotate with the rotation of the crankshaft;

an electrical outlet: and a controller comprising an inverter, the inverter configured to receive electrical power from the alternator and provide an electrical output to the electrical outlet;

wherein the controller is configured to temporarily suspend the electrical output to the electrical outlet at a first speed of the engine and turns on the electrical output after a second speed is attained of the engine; and wherein the second speed is more than the first speed.

19. The inverter generator of claim 10, wherein the first heat shield and the second heat shield prohibit the exhaust exiting the muffler exhaust from mixing with the cooling air flowing through the inverter generator.

* * * * *